US006257151B1

(12) United States Patent
Hale

(10) Patent No.: US 6,257,151 B1
(45) Date of Patent: Jul. 10, 2001

(54) SHELVING UNIT WITH INTERNAL LEVELING INDICATOR

(76) Inventor: Shiela Hale, 27 Almar La., Katonah, NY (US) 10536

( * ) Notice: Subject to any disclaimer, the term of this patent is extended or adjusted under 35 U.S.C. 154(b) by 0 days.

(21) Appl. No.: 09/391,834

(22) Filed: Sep. 8, 1999

(51) Int. Cl.[7] ..... A47B 23/00
(52) U.S. Cl. ..... 108/42
(58) Field of Search ..... 108/42, 180, 101, 108/158.12, 108; 248/916

(56) References Cited

U.S. PATENT DOCUMENTS

| | | | | |
|---|---|---|---|---|
| 2,624,118 | | 1/1953 | Anderson . | |
| 3,612,289 | * | 10/1971 | Zink | 108/180 |
| 4,228,982 | | 10/1980 | Sellera . | |
| 4,542,831 | * | 9/1985 | Dazza | 108/42 X |
| 4,834,450 | * | 5/1989 | Stickler | 108/180 X |
| 4,928,833 | | 5/1990 | Huizenga . | |
| 5,097,771 | * | 3/1992 | James, III | 108/42 |
| 5,263,260 | | 11/1993 | Smith . | |
| 5,454,331 | * | 10/1995 | Green | 108/180 |
| 5,463,817 | | 11/1995 | Leeds . | |
| 5,855,175 | * | 1/1999 | Forbes | 108/180 |

* cited by examiner

*Primary Examiner*—Jose V. Chen
(74) *Attorney, Agent, or Firm*—Ostrolenk, Faber, Gerb & Soffen, LLP

(57) ABSTRACT

A shelving unit that is leveled by and secured to a cleat, which contains a leveling indicator. At least two shelves of the unit are joined together by at least two upright standards, through complementary rabbets in the shelves and standards. The length of the cleat is substantially the spacing between two standards. The cleat is affixed to a wall after the cleat has been leveled using its leveling indicator. A shelf of the shelving unit is placed at the cleat to be automatically leveled there. This shelf is then fastened to the cleat, thereby fastening the shelving unit to the cleat, and through the cleat, fastening the shelving unit to the wall in a leveled manner.

15 Claims, 3 Drawing Sheets

FIG. 1
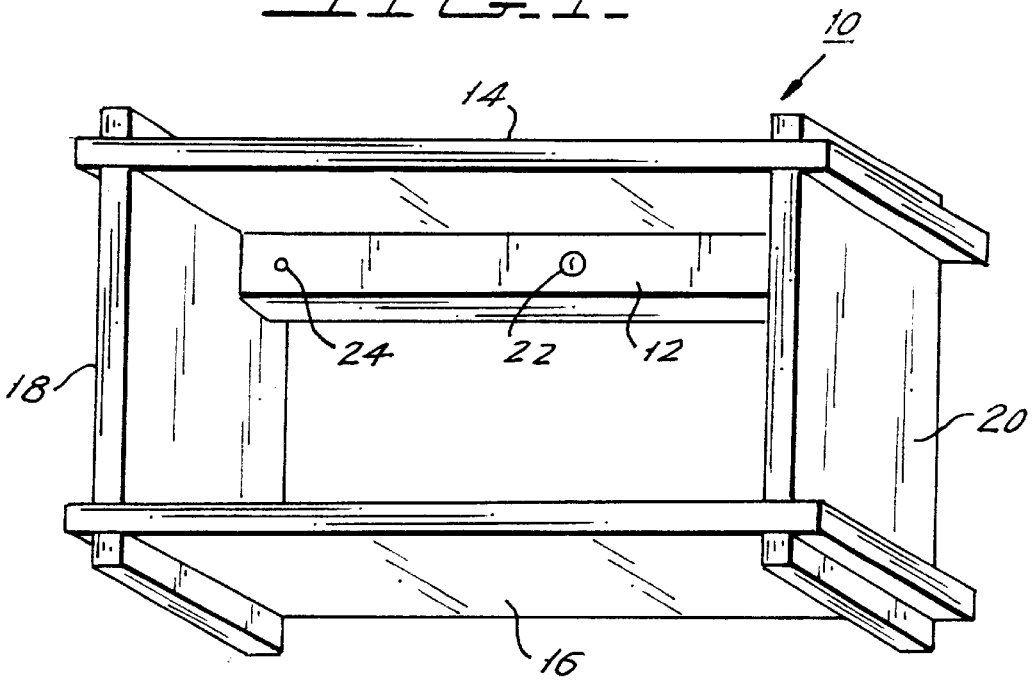
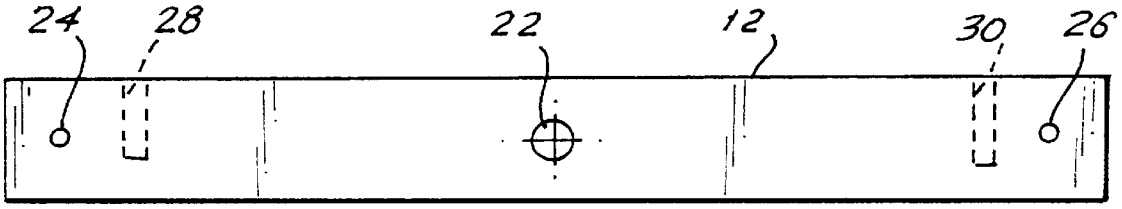
FIG. 3
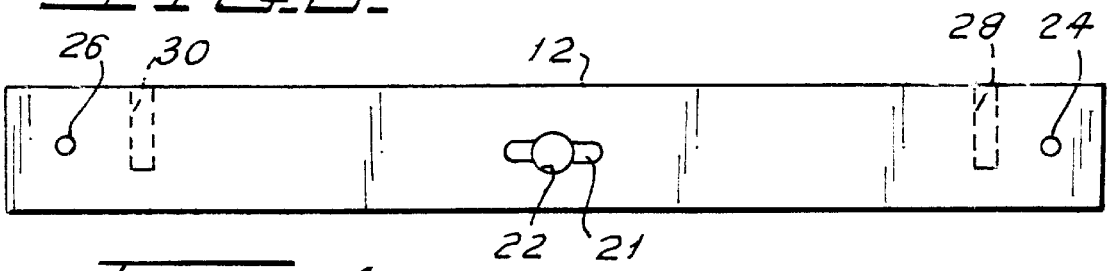
FIG. 4
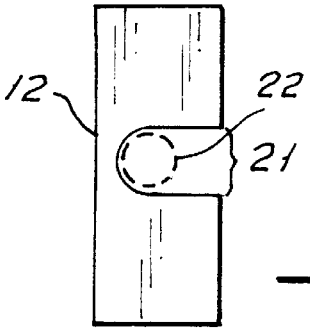
FIG. 5

SHELVING UNIT WITH INTERNAL LEVELING INDICATOR

FIELD OF THE INVENTION

The present invention generally relates to shelving and more particularly to a shelving unit that includes a support containing a leveling indicator.

BACKGROUND OF THE INVENTION

Typically, shelves should be hung level for the best appearance and to prevent articles placed upon the shelves from sliding or falling off. It is difficult to hang shelving at a precise tilt orientation to level the shelving and to orient it precisely horizontal.

Before shelving is fastened to a wall, to a surface, or the like, steps are taken to insure that the shelves are level. Initially, a shelf is placed against the wall and a separate leveling device may be placed upon the shelf. Once the shelf is correctly oriented, marks may be sketched on the wall to indicate the desired placement. The separate leveling device may be removed from the shelf. Using the marks on the wall as a guide, shelf supporting standards are installed. Then, the shelves are installed on the standards. The installation should result in leveled shelving.

Prior art discloses hanging devices for orienting picture frames. A frame may be oriented by using a separate bubble gauge or level that is annexed to the frame. The disclosed bubble gauge assists in aligning the frame. Other prior art discloses a device to assist in aligning adjacent sheets of wallpaper before hanging them on a wall. This device includes a spirit level to indicate when respective sheets of wallpaper are comparably disposed.

Other prior art relates to mounting shelving by using a rail for support. Before installing the rail on the wall, however, it needs to aligned. This is completed by use of a separate leveling device, which is not included in the rail.

SUMMARY OF THE INVENTION

An object of the invention is to level shelving being mounted to a surface.

Another object is to support the shelving.

A further object is to position the shelving laterally.

In the present invention, shelves are leveled by and secured to a support or cleat, which includes a leveling indicator.

In a preferred embodiment of the present invention, a shelving unit comprises a cleat having a leveling indicator and a plurality of leveled shelves secured to a plurality of upright standards. In a preferred form, the length of the cleat is related to the distance between the two standards that support the shelving. In one exemplary embodiment, the shelves and standards are assembled by cooperating notches or rabbets in the shelves and standards. But, numerous other techniques are known. The rabbeted connections precisely position the shelves on the standards.

Initially, the cleat is leveled by the user referring to its internal leveling indicator. Then the leveled cleat is affixed to a wall. Next, the shelves are interlocked to the standards via their respective rabbets. Then, the top shelf of the shelving unit is then placed at and particularly on the top surface of the cleat which automatically levels the shelves. The top shelf is then fastened to the cleat, thereby fastening the shelving unit to the cleat. Through the cleat, therefore, the shelving unit is fastened to the wall in a leveled position. With the standards spaced apart the length of the cleat, the shelving is precisely positioned laterally by the cleat, as well as vertically.

BRIEF DESCRIPTION OF THE DRAWINGS

FIG. 1 is a perspective view of a shelving unit according to the present invention;

FIG. 3 is a front view of the cleat;

FIG. 4 is a rear view of the cleat;

FIG. 5 is a side, cross-sectional view of the cleat;

Figure 2:
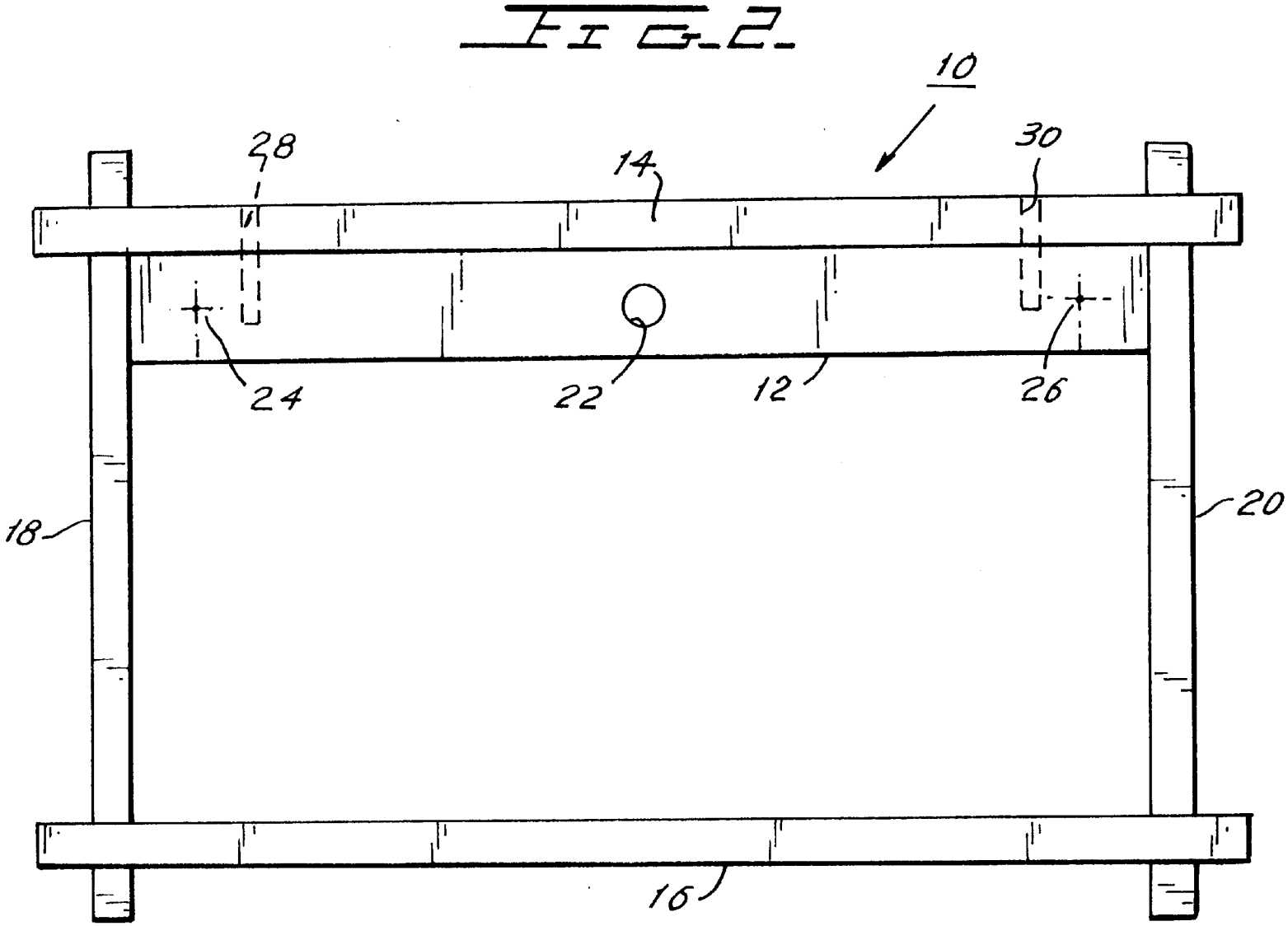
FIG. 2 is a front view of the shelving.

For the purposes of illustrating the present invention, there is shown in the drawings a form which is presently preferred, it being understood however, that the invention is not limited to the precise form shown.

DETAILED DESCRIPTION OF THE INVENTION

FIG. 1 shows an assembly of shelving that may be leveled by and laterally positioned by and secured to a cleat 12. In a preferred embodiment of the present invention, a shelving unit 10 includes a cleat 12, a plurality of at least two shelves 14 and 16, and a plurality of at least two standards 18 and 20.

The cleat 12 includes a leveling indicator 22. In order to assemble the shelving unit 10, the cleat 12 first is affixed or mounted on a wall. Using the internal leveling indicator 22, the cleat 12 is initially leveled and then mounted on the wall. The internal leveling indicator 22 can be a spirit level or bubble level.

Next, the shelving, which is illustrated in the preferred embodiment as two shelves 14 and 16 adjoined to two upright standards 18 and 20, needs to be constructed. This can be accomplished by the use of rabbets (i.e., grooves located near the end of a shelf or along the length of a standard), which allow different pieces to fit into one another by forming joints between the respective pieces. The shelves 14 and 16 (see FIG. 6), as well as the standards 18 and 20 (see FIG. 7), each contain two rabbets. Thus, to construct the shelving, the rabbets of shelves 14 and 16 interlock with the rabbets of standards 18 and 20 to form joints between the interlocked pieces.

In the preferred embodiment, the standards 18 and 20 are connected to extend substantially perpendicularly downwardly with respect the shelves 14 and 16. Thus, the standards 18 and 20 form the exterior sides of the shelving unit 10, while the shelves 14 and 16 form the top and bottom sides of the shelving unit 10. In addition, the standards 18 and 20 provide support for the shelves 14 and 16, and vice versa.

After the shelving unit 10 has been assembled, the top shelf 14 is placed to rest on the top surface of the cleat 12. Since the cleat 12 has already been leveled with the guidance provided by the internal leveling indicator 22, the top shelf 14, the bottom shelf 16 and other shelves, if any, are automatically leveled as well. As seen in FIG. 2, the top shelf 14 can be secured to the cleat 12 through fastening elements inserted into apertures 28 and 30. In addition, the length of the cleat 12 is preferably substantially equal to the distance between the inward facing sides of the standards 18 and 20. Thus, when the shelving is placed atop the cleat 12, the top shelf 14 along with the two standards 18 and 20 should fit snugly around the cleat 12. In alternative embodiments of the present invention, the bottom shelf 16, rather than the top shelf 14, can rest on and be secured to the cleat 12 or the shelf can be below the cleat, etc.

FIG. 3 depicts a front view of the cleat 12 that is described above. The cleat 12 is affixed to a wall by fastening elements passed through apertures 24 and 26. The cleat 12 contains a leveling indicator 22, which is located within the cleat 12. For example, it the leveling indicator 22 is a bubble level, the cleat 12 is level when the air bubble contained in the leveling indicator 22 is substantially centered.

A rear view of the cleat 12 is shown in FIG. 4. The leveling indicator 22 can be installed into the cleat 12 through its rear side. An opening 21 is provided in the cleat 12, through which the leveling indicator 22 is installed. Preferably, the leveling indicator 22 is placed in the center of the cleat 12. However, the leveling indicator 22 can be located anywhere within the cleat 12. FIG. 5 is a cross sectional view of the cleat 12.

Figure 6:
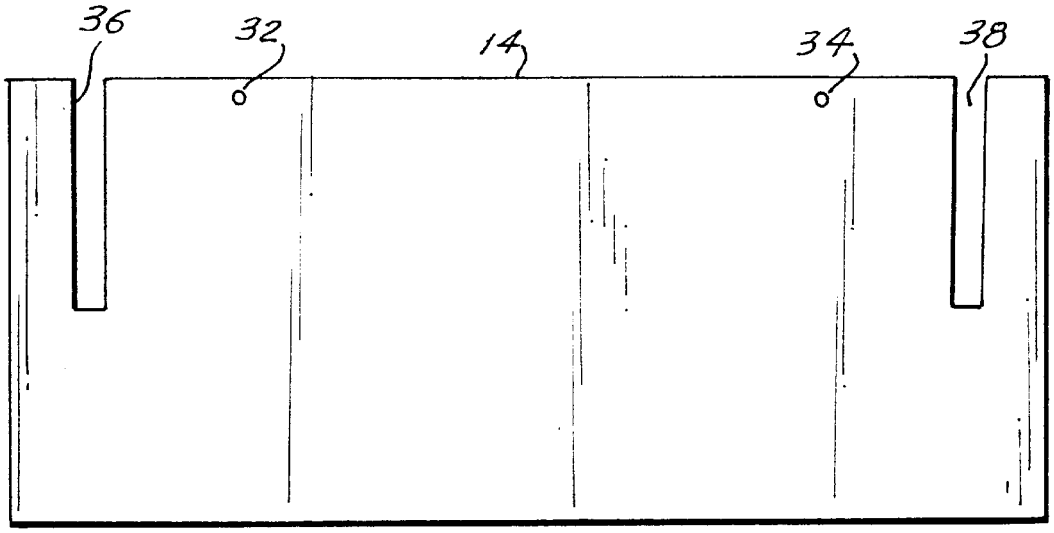
FIG. 6 is a plan view of a shelf.
Figure 8:
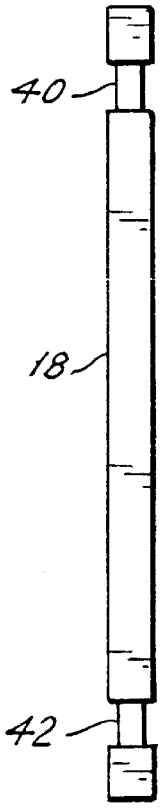
FIG. 8 is a front view of a standard.
Figure 7:
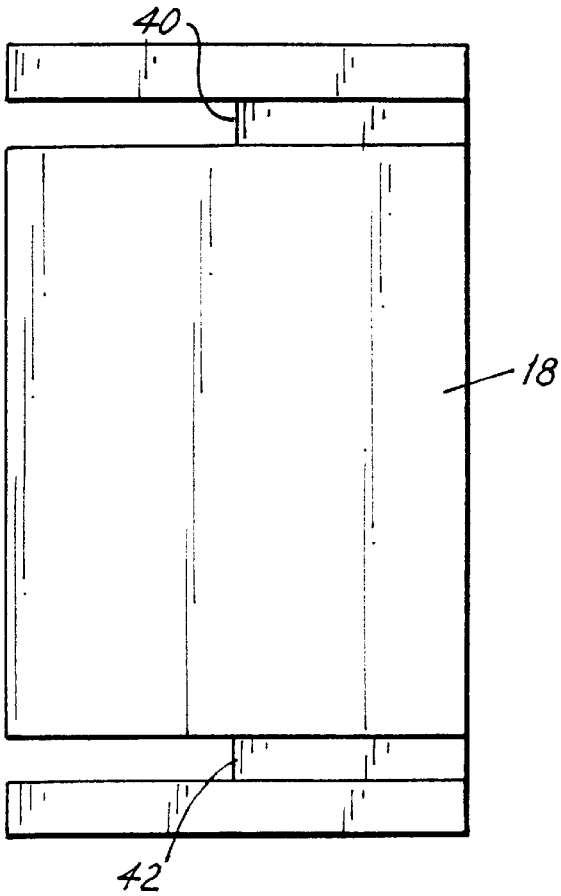
FIG. 7 is a plan view of a standard.

A top view of a shelf 14 is depicted in FIG. 6. The top shelf 14 contains rabbets 36 and 38. Although not pictured, the bottom shelf 16 contains rabbets complementary to those of the top shelf 14. FIGS. 7 and 8 show a top and a side view of a standard 18, respectively. The standard 18 contains rabbets 40 and 42. Similarly, the other standard 20 (not shown) contains rabbets like those of standard 18. As described above, in connecting the shelves 14 and 16 to the standards 18 and 20, the rabbets 40 and 42 contained in the standards 18 and 20 are interlocked with the rabbets 36 and 38 of the top shelf 14 and the bottom shelf 16.

In alternative embodiments of the present invention, a shelving unit may include a plurality of cleats, shelves, and standards. Thus, the design of these shelving units are only limited to what is mechanically feasible.

Although the present invention has been described in relation to particular embodiments thereof, many other variations and other uses will be apparent to those skilled in the art. It is preferred, therefore, that the present invention be limited not by the specific disclosure herein, but only by the accompanying claims.

What is claimed is:

1. A shelving unit comprising:

a cleat having a first surface;

a leveling indicator integrally provided in the cleat for indicating the orientation of the first surface of the cleat; and a shelf having a second surface and being mountable and securable to the cleat with the first surface of the cleat in contact with the second surface of the shelf so that, upon mounting the second surface of the shelf onto the first surface of the cleat, the second surface of the shelf is rotationally fixed and automatically achieves the orientation of the first surface of the cleat oriented with the guidance of the indicator.

2. The shelving unit of claim 1, wherein the first surface of the cleat is a top surface thereof and the shelf is mountable on and securable to the top surface of the cleat.

3. The shelving unit of claim 1, wherein the shelf has opposite lateral ends, the shelving unit further comprising:

a first standard connected to the shelf near one of the ends; and a second standard connected to the shelf near the other of the ends.

4. The shelving unit of claim 3, further comprising an additional shelf connected to the first and second standards.

5. The shelving unit of claim 3, wherein the first surface of the cleat has a lateral length that is substantially the distance between the first and second standards.

6. The shelving unit of claim 4, wherein the first and second standards are connected substantially perpendicularly to the shelves.

7. The shelving unit of claim 6, wherein the first surface of the cleat has a lateral length that is substantially the distance between the first and second standards.

8. The shelving unit of claim 6, wherein the shelf has a first rabbet located near the one end of the shelf and a second rabbet located near the other end of the shelf, the first standard has a length and a third rabbet located along the length of the first standard, the second standard has a length and a fourth rabbet located along the length of the second standard, and wherein the shelf is connected to the first and second standards by interlocking the first rabbet of the shelf with the third rabbet of the first standard and by interlocking the second rabbet of the shelf with the fourth rabbet of the second standard.

9. The shelving unit of claim 8, further comprising a second shelf connected to the first and second standards;

the second shelf has two ends with a fifth rabbet located near one of the ends of the second shelf and a sixth rabbet located near the other of the ends of the second shelf;

the first standard has a seventh rabbet located along the length of the first standard and the second standard has an eighth rabbet located along the length of the second standard; and the second shelf is connected to the first and second standards by interlocking the fifth rabbet of the second shelf with the seventh rabbet of the first standard and by interlocking the sixth rabbet of the second shelf with the eighth rabbet of the second standard.

10. The shelving unit of claim 7, wherein the first surface of the cleat has a lateral length that is substantially the distance between the first and second standards.

11. The shelving unit of claim 1, wherein the cleat has a lateral length and the leveling indicator is substantially centrally located along the lateral length of the cleat.

12. The shelving unit of claim 1, wherein the leveling indicator is a bubble level.

13. A combination comprising:

a support which comprises a cleat having a first surface, and a leveling indicator integrally provided in the cleat for indicating the orientation of the first surface of the cleat; and a supported object having a second surface and being mountable and securable to the cleat with the first surface of the cleat in contact with the second surface of the supported object so that, upon mounting the second surface of the supported object onto the first surface of the cleat, the second surface of the supported object is rotationally fixed and automatically achieves the orientation of the first surface of the cleat oriented with the guidance of the indicator.

14. The combination of claim 13, wherein the first surface of the cleat is a top surface thereof, and the supported object is mountable on and securable to the top surface of the cleat.

15. The combination of claim 14, wherein the supported object has opposite lateral ends;

a first standard connected to the object near one of the ends, a second standard connected to the object near the other of the ends; and the top surface of the cleat has a lateral length that is substantially the distance between the first and second standards.

* * * * *